US005660000A

United States Patent [19]

MacIntyre

[11] Patent Number: 5,660,000

[45] Date of Patent: Aug. 26, 1997

[54] MOVABLE TWO-FOLD SEATING ASSEMBLY

[76] Inventor: James R. MacIntyre, 1680 Woodglen La., Altadena, Calif. 91001

[21] Appl. No.: 694,545

[22] Filed: Aug. 9, 1996

[51] Int. Cl.[6] ..... E04H 3/12

[52] U.S. Cl. ..... 52/9; 52/6; 52/7; 52/8; 52/10; 182/152; 108/115

[58] Field of Search ..... 52/6, 7, 8, 9, 10; 182/152; 108/115, 134

[56] References Cited

U.S. PATENT DOCUMENTS

| | | | |
|---|---|---|---|
| 2,183,056 | 12/1939 | Albach et al. | 52/9 |
| 2,978,754 | 4/1961 | Wilson | 52/7 X |
| 3,869,835 | 3/1975 | Makintosh | 52/9 |
| 4,232,488 | 11/1980 | Hanley | 52/7 |
| 4,854,092 | 8/1989 | Chatenay épouse | 52/6 X |
| 4,872,295 | 10/1989 | Fujita | 52/7 |
| 4,885,878 | 12/1989 | Wuu | 52/6 |
| 4,908,999 | 3/1990 | Harris | 52/8 |
| 5,325,640 | 7/1994 | Luedke et al. | 52/7 X |
| 5,349,789 | 9/1994 | Andert et al. | 52/7 |
| 5,392,718 | 2/1995 | Stevens | 52/7 X |

*Primary Examiner*—Wynn E. Wood

*Attorney, Agent, or Firm*—Watson Cole Stevens Davis, P.L.L.C.

[57] ABSTRACT

A movable two-fold seating assembly includes an upright support structure, a forward seating section pivoted to the support structure, and a rearward seating section pivoted to the structure. Forward and rearward frame structures are pivoted to the free ends of the seating sections for supporting the same on the ground. The frame structures are folded to underlie their respective seating sections, and the seating sections are folded about opposing sides of the upright support structure. The entire seating assembly is transportable in the folded condition by lowering ground engaging wheels to the ground from a base structure of the upright support, and lifting the forward end of the assembly as by a forklift.

5 Claims, 4 Drawing Sheets

10
11
12
13
14
16
17
18
19
21
22
23
27
28
29
31
38
41
47
49
51
52
53
54
55
56
57
58
59
61
8
G 18
19
11
21
23
24
25
26
27
28
32
33
34
35
36
37
38
39
41

47
51
52
23
42
48
45
43
46
25
9
62
9
44
12
46
45
48
52
51
23
42
47

44
62
63
43
64

MOVABLE TWO-FOLD SEATING ASSEMBLY

BACKGROUND OF THE INVENTION

This invention relates generally to folding grandstands, and more particularly to such a stand comprising independent assemblies each with a forward and rearward seating section foldable about an upstanding support structure capable of being transported during the process of storage, and during a reconfiguration of the seating assemblies installed in, for example, a sports stadium.

A large sports stadium, for example, often times requires additional, perimeter seating for increasing the seating capacity of the stadium or for reconfiguring the stadium for different events and sporting activities.

Known seating assemblies utilize large seating sections constructed like trailers that are towed into position. The difficulty with such a design is that it takes up a great deal of storage space when not in use. And, telescoping-type seating systems can be unstable when being transported because of their height.

SUMMARY OF THE INVENTION

It is therefore an object of the present invention to provide a seating assembly which is easily movable, is capable of use in many configurations, and can be folded into a small storage depth.

The movable folding seating assembly according to the invention has an upstanding support structure with a base structure supported on a ground surface, the upstanding structure having at an upper end thereof crossbar structure extending from opposite sides of the upstanding support. A forward seating section is horizontally hinged at a rearward portion thereof to the crossbar structure, and a rearward seating section is horizontally hinged at a forward portion thereof to the crossbar structure. When opened for use the sections are adapted to occupy a plane of gradual inclination to the horizontal. Forward and rearward frame structures support the free ends of the forward and rearward seating sections on the ground surface. The seating sections are capable of being folded when not in use for lying along the opposite sides of the upstanding support structure, and the frame sections are hinged to the seating sections for underlying the same upon the folding of the seating sections.

Other objects, advantages and novel features of the invention will become more apparent from the following detailed description of the invention when taken in conjunction with the accompanying drawings.

DETAILED DESCRIPTION OF THE INVENTION

Figures 1, 10:
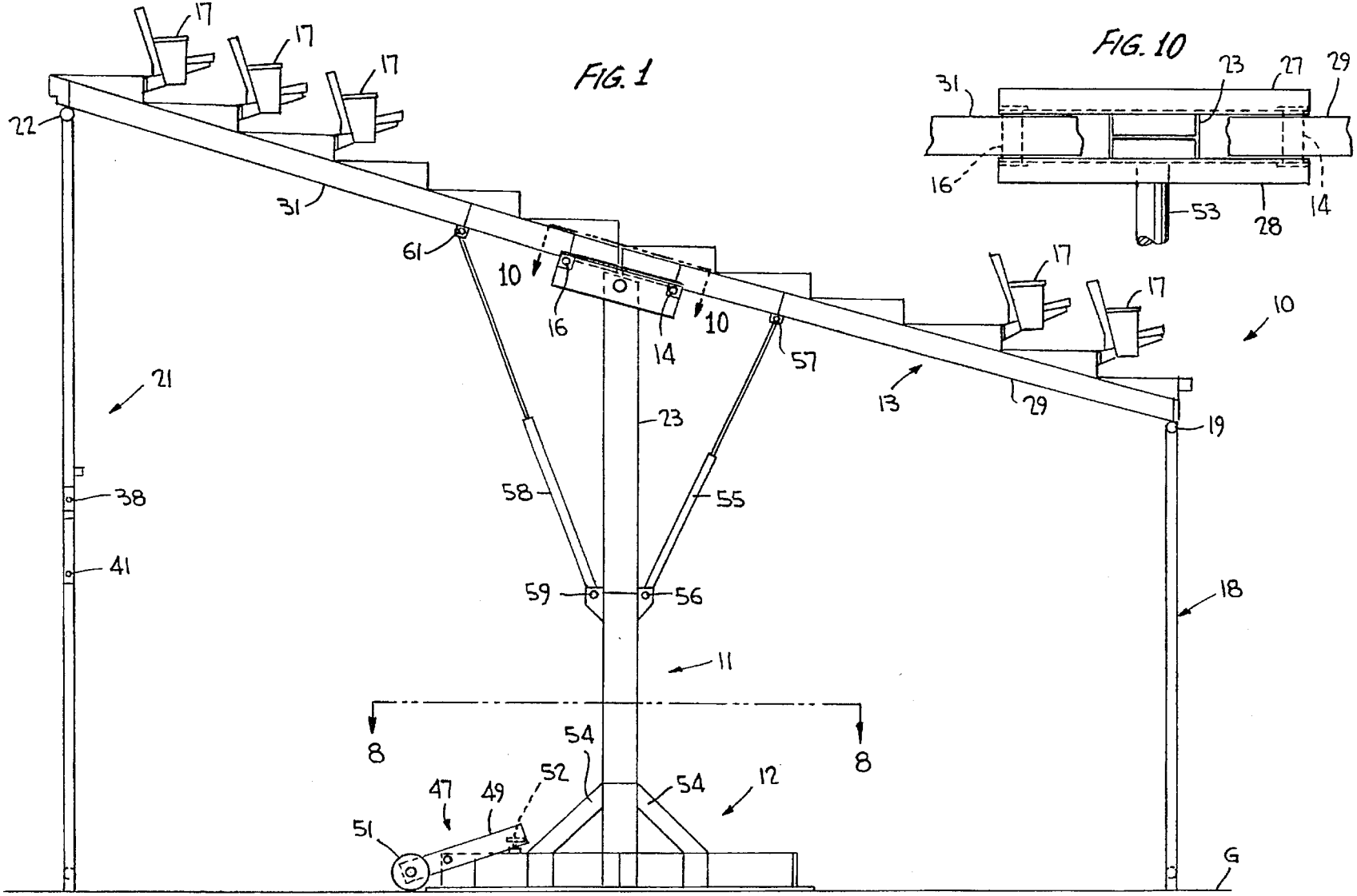
FIG. 1 is a side elevational view of a movable folding seating assembly according to the invention, shown when fully opened.
FIG. 10 is a view taken substantially along the line 10—10 in FIG. 1.
Figures 2, 3, 4:
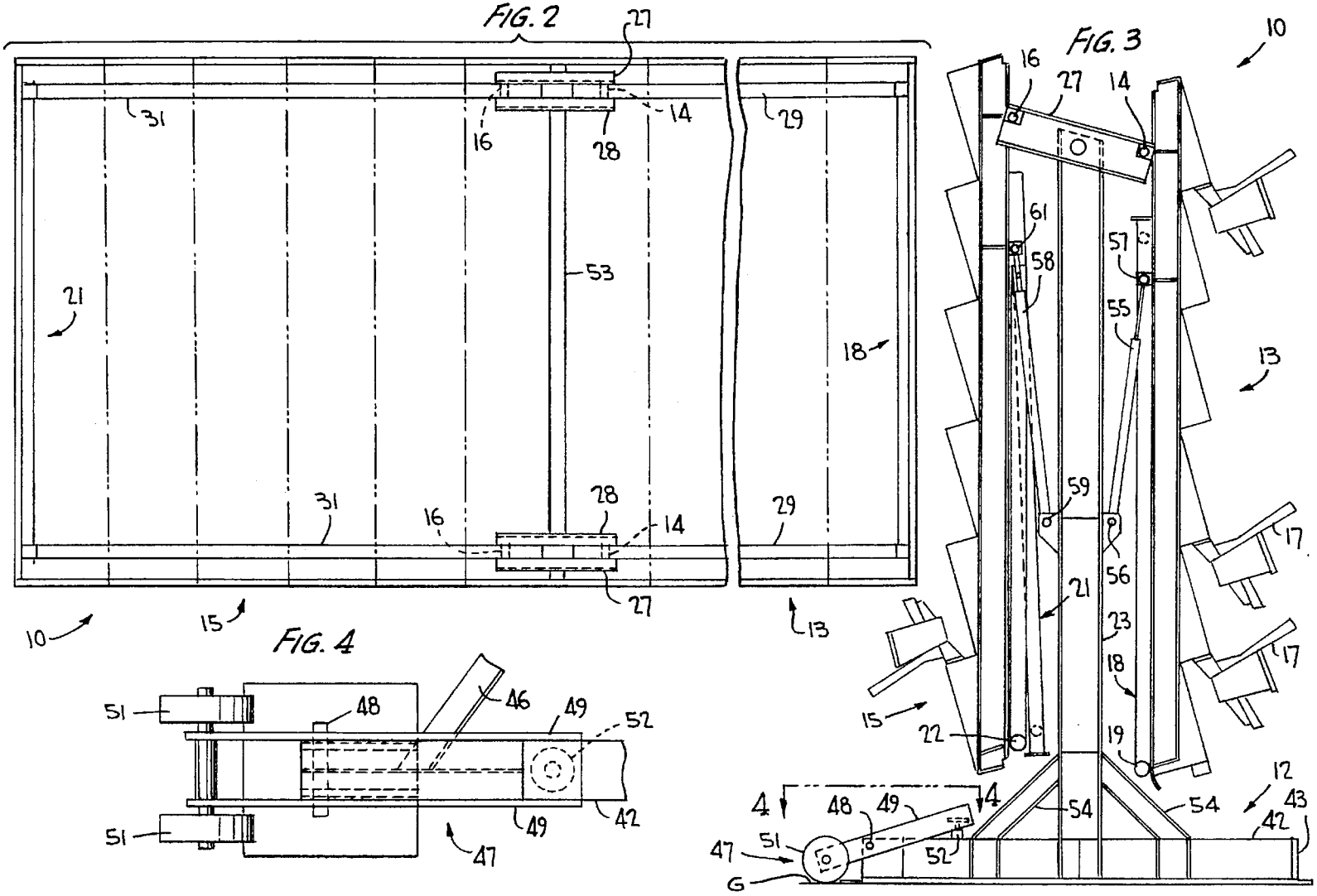
FIG. 2 is a top plan view of the assembly of FIG. 1 with the decking and seats removed for clarity.
FIG. 3 is a view similar to FIG. 1 showing the assembly in its folded position.
FIG. 4 is a view taken substantially along the line 4—4 of FIG. 3.

Turning now to the drawings wherein like reference characters refer to like and corresponding parts throughout the several views, the seating assembly of the invention is generally designated 10 in FIGS. 1, 2 and 3 as comprising an upstanding support structure 11 having a base structure 12 at the lower end thereof for supporting the assembly on the ground G. A forward seating section 13 is horizontally hinged to structure 11 as at 14, and a rearward seating section 15 is horizontally hinged to structure 11 as at 16.

The seating sections when opened for use as shown in FIG. 1 are adapted to occupy a plane of gradual inclination to the horizontal, each of the sections having a top decking (not shown) and a plurality of seats 17 mounted thereon in some normal manner, forming no part of the invention.

A forward frame structure 18 is hinged at 19 to the forward end of seating section 13, and extends to the ground G for supporting and stabilizing the forward seating section. Similarly, a rearward frame structure 21 is hinged as at 22 to the rearward end of seating section 15, and extends to the ground G for supporting and stabilizing the rearward seating section.

Figures 5, 6, 7:
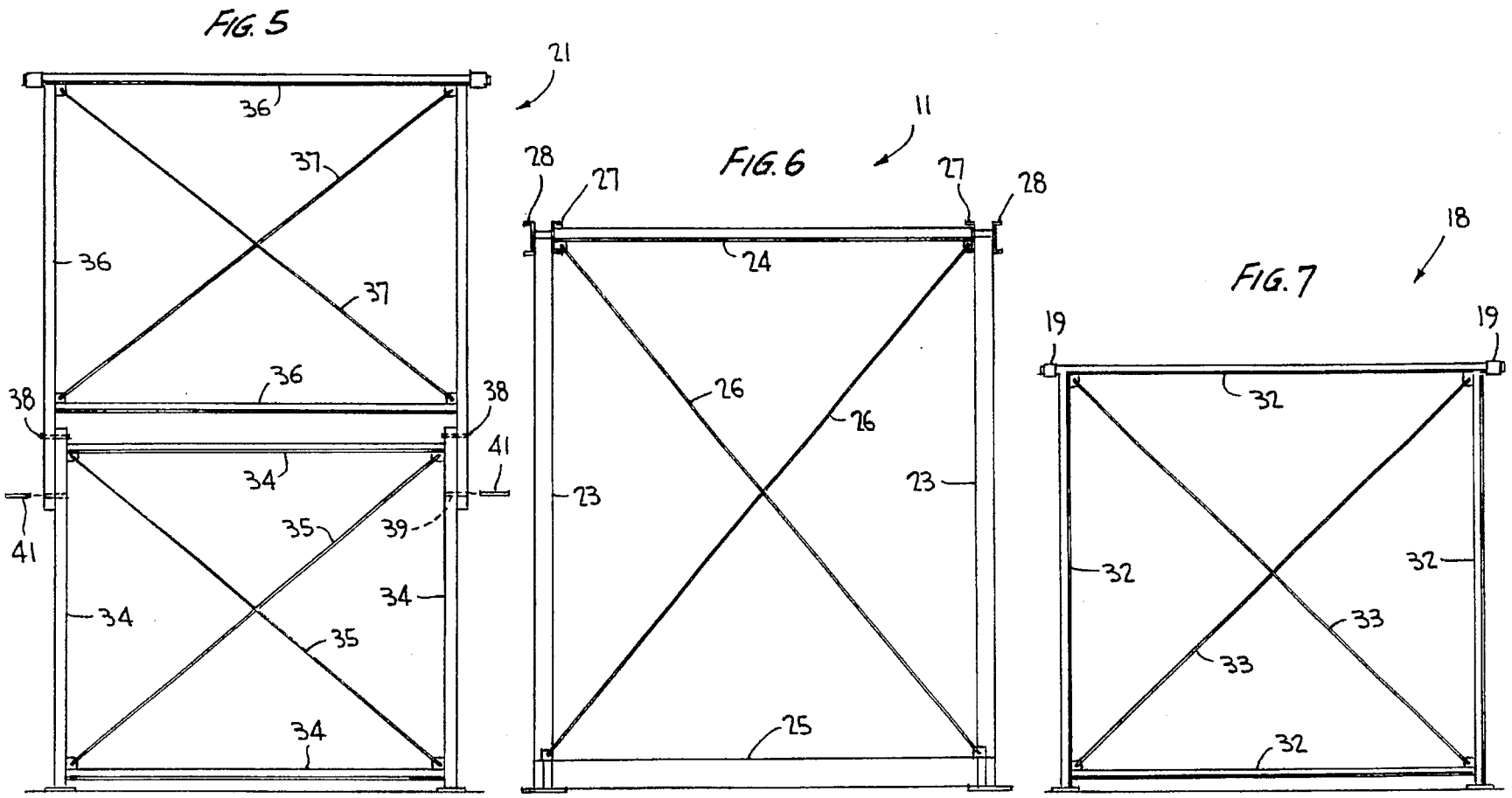
FIG. 5 is a side plan view of the rearward frame structure of the assembly.
FIG. 6 is a side plan view of the upstanding support structure of the assembly.
FIG. 7 is a side plan view of the forward frame structure of the assembly.

Upstanding support structure comprises a pair of spaced columns 23, as shown in FIG. 6, upper crossbars 24 and lower crossbeams 25, and X braces of steel rods 26 each having a standard turnbuckle (not shown).

Each column 23 has mounted at its upper end a pair of opposing, short, crossbeams 27, 28 lying at the same angle of inclination to the horizontal as designed for the seating sections when in the FIG. 1 open position. Longitudinal end beams 29 (FIG. 2) of forward seating section 13, which support the decking (not shown) on which the seats are mounted, are hinged to the crossbeam pairs as at 14, Similarly, end beams 31 of rearward seating section 15 which support the decking (not shown) on which the seats are mounted, are hinged as at 15 to the pairs of crossbeams 27, 28.

Forward frame structure 18 is shown in detail in FIG. 7 as comprising a frame of standard pipes 32 interconnected at the corners and braced by crossrods 33 each with a standard turnbuckle (not shown).

Rearward frame structure 21 is detailed in FIG. 5 as comprising a lower frame of interconnected hollow bars 34, and cross bracing 35 with standard turnbuckles (not shown). An upper frame of interconnected hollow bars 36 are crossbraced as at 37 (each with a turnbuckle), with the upper and lower frames being hinged together as at 38, the vertical bars of the upper and lower frames overlapping. Aligned openings 39 are provided in bars 34, 36 through which pins 41 are manually extended for maintaining the upper and lower frames of structure 21 in an erect position shown in FIG. 1.

Figure 8:
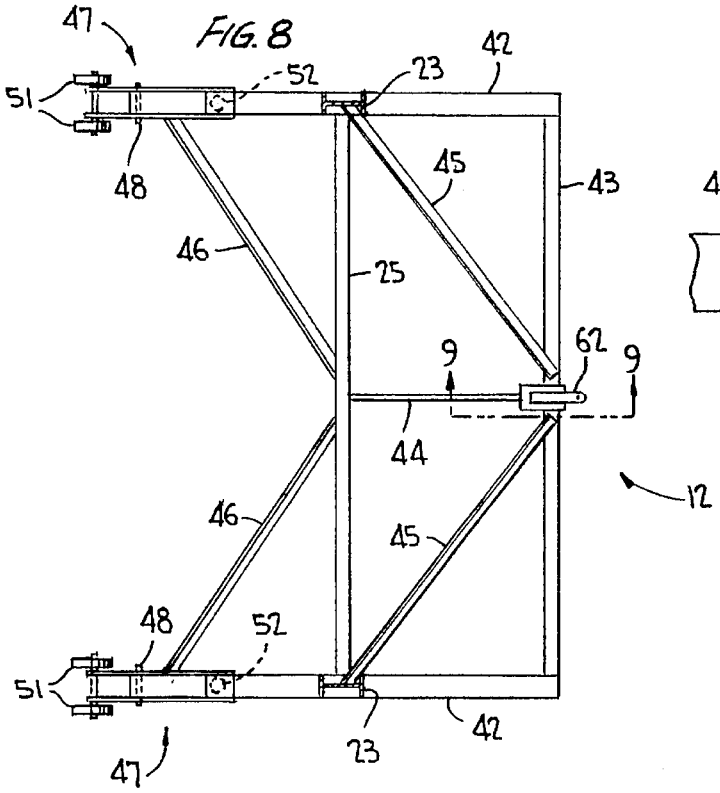
FIG. 8 is a top plan view of the base support structure of the assembly.

Base structure 12, detailed in FIG. 8, comprises heavy longitudinal beams 42, and a heavy crossbeam 43 of a size similar to crossbeam 25, with a longitudinal brace 44 extending between beams 25 and 43, diagonal braces 45 extending between columns 25 and beam 43, and further diagonal braces 46 extending between beams 42 and crossbeam 25.

At the rearward end of each beam 42 is a ground engaging wheel assembly 47 pivotally connected thereto as at 48 (FIGS. 3 and 4). Each assembly comprises a pair of opposing support legs 49 supporting a pair of ground engaging wheels 51 at the rearward end thereof, and supporting a hydraulic/pneumatic piston/cylinder unit 52 at the forward end thereof.

Upstanding support structure 11, as shown in FIG. 2, includes a transversely extending support pipe 53 welded to inboard crossbeams 28 (see also FIG. 12). And, diagonal foot braces 54 (FIG. 3) extend between columns 23 of the upright support structure and beams 42 of the base structure for resisting loads applied to the upstanding support structure in forward and rearward directions.

A pair of hydraulic or pneumatic piston/cylinder units or struts 55 (only one shown in FIG. 1 ) are pivotally connected to columns 23 as at 56 and to the underside of end beams 29 as at 57, both units 55 lying outboard of the opposing sides of forward frame section 18 so as to avoid interference therewith in the folded condition of FIG. 3. Similarly, a pair of hydraulic or pneumatic piston/cylinder units or struts 58 are pivotally connected as at 59 to columns 23 of the upright support structure, extend diagonally in the open condition of assembly 10 shown in FIG. 1, and are pivotally connected as at 61 to end beams 31 of rearward seating section 15. Units 58 lie outboard of the opposing sides of rearward frame structure 21 so as to avoid interference therewith in the FIG. 3 folded position.

According to the invention assembly 10 is capable of being folded into the storage and transport position of FIG. 3 in a simple and efficient manner without the need for heavy equipment. Pins 41 extending between the upper and lower frames of rearward frame structure 21 are removed such that the frames can be folded to overly one another. Forward frame structure 18 is folded to underlie forward seating section 13 and may be tacked to the underside thereof in some normal manner. Similarly, the collapsed frames of rearward frame section 21 may be folded to underlie rearward seating section 15 and may be tacked thereto in some manner. The pistons of units 55 and 58 may then be retracted permitting the forward and rearward seating sections to be folded about opposite sides of the upright support structure 11, as shown in FIG. 3.

It should be pointed out that in the process of folding the seating assembly from its FIG. 1 to its FIG. 3 position, the forward and rearward frame structures need not be tacked in place first beneath their respective seating sections, but rather could simply be folded simultaneously with the folding of the seating sections, without departing from the invention.

Figure 9:
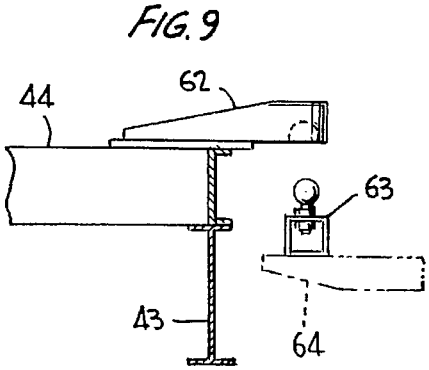
FIG. 9 is a view taken substantially along the line 9—9 of FIG. 8.

As shown in FIGS. 8 and 9, the forward end of base structure 12 is provided with the typical trailer hitch connection 62 to be coupled with a ball type hitch 63 mounted at the end of the jaws 64 of a forklift (not shown).

Therefore when it is intended to transport the folded seating assembly along the ground G, units 52 are actuated for pivoting wheel pairs 51 into engagement with the ground thereby lifting the rear end of the folded seating assembly 10 slightly off the ground. Jaws 64 of the forklift are then elevated to couple ball hitch 62 with trailer hitch 62 and to elevate the forward end of the folded seating assembly 10 off the ground whereupon the assembly may be simply transported to storage or relocated at the perimeter of the stadium when it is desired to reconfigure the seating arrangement.

The seating assembly can be opened into its FIG. 1 position from its folded position of FIG. 3 by simply extending the pistons of units 55 and 58 out of their cylinders, and erecting the forward and rearward frame structures back onto the ground into vertical positions.

A number of assemblies 10 lie contiguous to one another about the field perimeter, and with the ground engaging wheels raised above the wheels, the base structure 12 lies flat on the ground and the opposing forward and rearward ends of the assembly are supported by the forward and rearward frame structures which render a secure and highly stable seating assembly when supported on the ground. Yet, each seating assembly can be folded into a small storage depth into the FIG. 3 position, and can be easily transported, both without the need for heavy equipment and extensive manpower.

The seating assembly can be of a trapezoidal shape to accommodate the corners of the stadium, and the forward and rearward seating sections can be relatively longer or shorter compared to that illustrated in the drawings.

Obviously, many other modifications and variations of the present invention are made possible in the light of the above teaching. It is therefore to be understood that within the scope of the appended claims the invention may be practiced otherwise than as specifically described.

What is claimed is:

1. A movable folding seating assembly comprising, an upstanding support structure having a base structure supported on a ground surface and having at an upper end thereof a crossbeam structure extending from opposite sides of said support structure, a forward seating section horizontally hinged at a rearward portion thereof to said crossbeam structure, a rearward seating section horizontally hinged at a forward portion thereof to said crossbeam structure, the sections adapted when opened for use to occupy a plane of gradual inclination to the horizontal, forward and rearward frame structures respectively supporting the forward and rearward seating sections on the ground surface, said forward and rearward sections being hinged to said crossbar structure for lying along said opposite sides of said support structure upon a folding of said sections, and said forward and rearward frame sections being hinged to said forward and rearward seating sections, respectively, for underlying said forward and rearward seating sections upon the folding of said seating sections.

2. The seating assembly according to claim 1, wherein hydraulically or pneumatically operated struts interconnect said upstanding support structure with said seating sections to facilitate the folding thereof.

3. The seating assembly according to claim 1, wherein the base structure has ground engaging wheels mounted for movement into and out of engagement with the ground surface.

4. The seating assembly according to claim 1, wherein said wheels are located at only a rearward end of said base structure, the seating assembly when folded being capable of being moved upon lifting a forward end of said structure with the wheels engaging the ground surface.

5. The seating assembly according to claim 1, wherein said rearward frame structure comprises interlinked frames for collapsing the rearward frame structure upon the folding of the seating sections.

* * * * *